US006813974B2

(12) United States Patent
McCabe et al.

(10) Patent No.: US 6,813,974 B2
(45) Date of Patent: Nov. 9, 2004

(54) FILTER GRIP

(76) Inventors: Benjamin McCabe, 939 E. 101st St., Indianapolis, IN (US) 46280; Joseph Roach, 8761 E. CR 600 S., Cloverdale, IN (US) 46120

( * ) Notice: Subject to any disclaimer, the term of this patent is extended or adjusted under 35 U.S.C. 154(b) by 131 days.

(21) Appl. No.: 10/171,307

(22) Filed: Jun. 12, 2002

(65) Prior Publication Data

US 2002/0189408 A1 Dec. 19, 2002

Related U.S. Application Data

(60) Provisional application No. 60/298,972, filed on Jun. 18, 2001.

(51) Int. Cl.[7] ..... B25B 13/52
(52) U.S. Cl. ..... 81/64; 451/533; 451/523
(58) Field of Search ..... 81/64, 3.43; 451/533, 451/523, 539

(56) References Cited

U.S. PATENT DOCUMENTS

| | | | | | |
|---|---|---|---|---|---|
| 81,986 | A | | 8/1868 | Crane | |
| 449,930 | A | | 4/1891 | Dubey | |
| 2,156,492 | A | * | 5/1939 | Davis | 451/533 |
| 3,748,792 | A | | 7/1973 | Lamb | |
| 3,785,094 | A | | 1/1974 | Holzhauer | |
| 3,789,555 | A | | 2/1974 | Means | |
| 3,885,249 | A | | 5/1975 | De Brabander | |
| 4,477,938 | A | | 10/1984 | Rogut | |
| 4,558,542 | A | * | 12/1985 | Marton | 451/490 |
| 4,712,552 | A | * | 12/1987 | Pangburn | 606/131 |
| 4,714,644 | A | * | 12/1987 | Rich | 428/136 |
| 4,754,499 | A | | 7/1988 | Pirie | |
| 5,109,637 | A | * | 5/1992 | Calafut | 451/495 |
| 5,134,809 | A | | 8/1992 | Morton et al. | |
| 5,140,785 | A | * | 8/1992 | Eleouet | 451/523 |
| 5,388,485 | A | | 2/1995 | Auble | |
| 5,429,545 | A | * | 7/1995 | Meyer | 451/523 |
| 5,432,954 | A | | 7/1995 | Taylor | |
| D372,111 | S | | 7/1996 | Zeigler | |
| 5,603,679 | A | | 2/1997 | Reis | |
| 5,642,527 | A | | 7/1997 | Savage | |
| 5,770,297 | A | | 6/1998 | Grubich | |
| D401,127 | S | | 11/1998 | Plantz et al. | |
| 6,042,462 | A | * | 3/2000 | Baratti | 451/533 |
| 6,099,603 | A | | 8/2000 | Johnson | |
| 6,178,554 | B1 | | 1/2001 | Pake et al. | |

* cited by examiner

*Primary Examiner*—Lee D. Wilson
(74) *Attorney, Agent, or Firm*—Baniak Pine & Gannon

(57) ABSTRACT

A filter grip includes a sheet with a first surface and a second surface, both surfaces having a grit texture. The sheet defines a radius of curvature. The filter grip is configured to provide a non-slip engagement between a user's hand or tool and an oil filter.

13 Claims, 3 Drawing Sheets

FILTER GRIP

This application claims priority under 35 U.S.C. 119(e) to U.S. Provisional Application Ser. No. 60/298,972, filed Jun. 18, 2001, which is expressly incorporated by reference herein.

BACKGROUND AND SUMMARY OF THE INVENTION

The present invention relates to a tool, and particularly, to a tool for handling a potentially hot and/or slippery object. More particularly, the present invention relates to a tool for gripping an oil filter.

According to the disclosure, an oil filter grip includes a two-sided sheet with a grit outer surface and a grit inner surface. In the illustrative embodiment, the oil filter grip is formed by curving a sheet of sandpaper (with grit facing inwardly) about a desired curved formation, applying a middle layer of adhesive, and then forming another sheet of sandpaper with grit facing outwardly about the first sheet of sandpaper, such that the backs of the sheets are adhered to each other.

Additional features of the disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
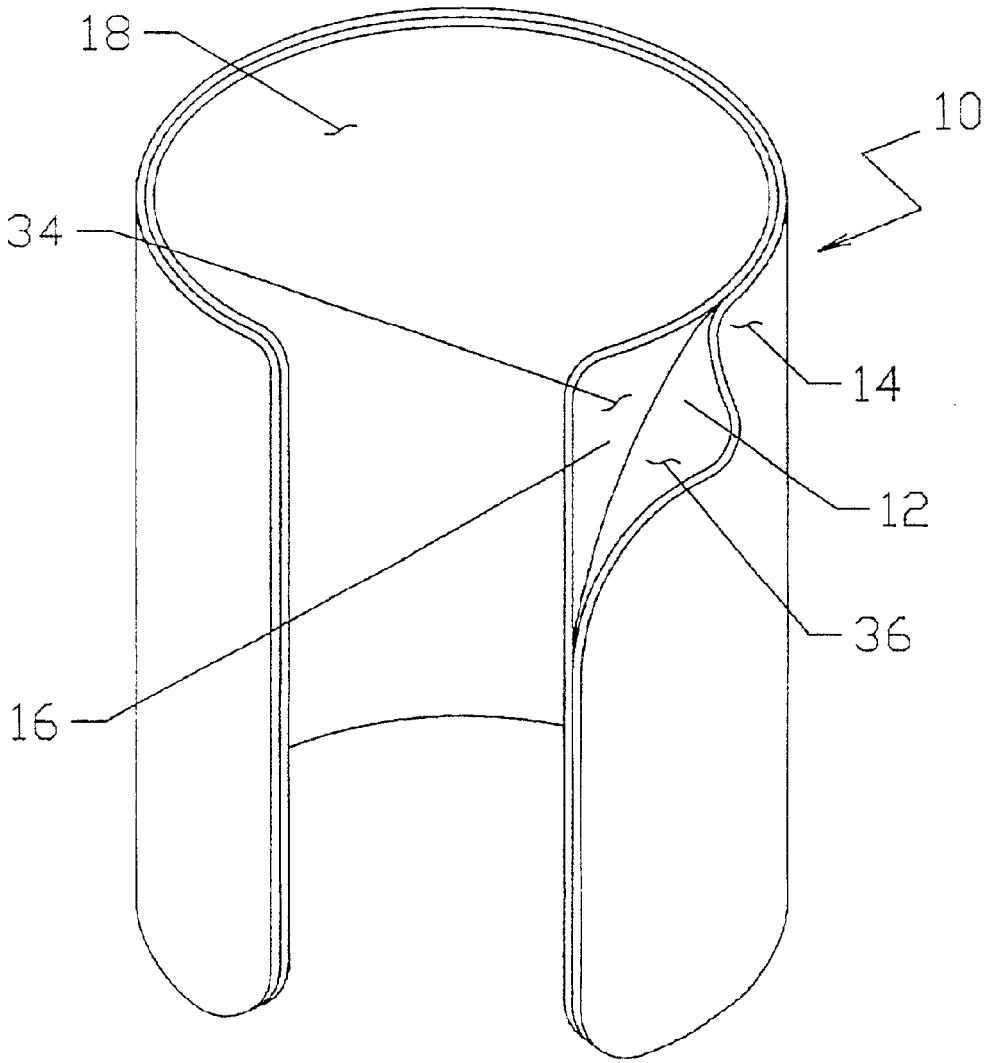
FIG. 1 is a perspective view of a filter grip in accordance with the present invention.
Figure 2:
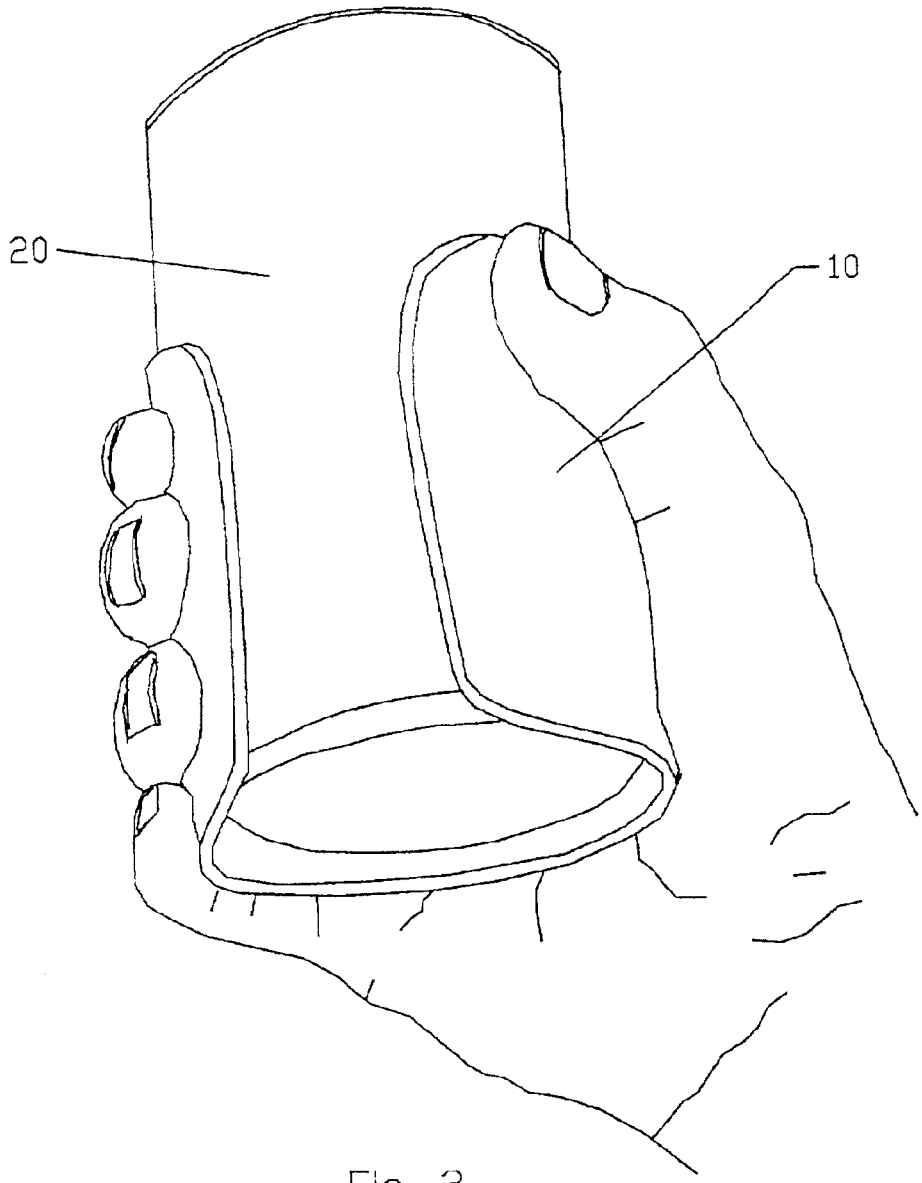
FIG. 2 is a perspective view showing the filter grip encompassing a portion of an oil filter, thereby facilitating removal and handling of the oil filter.

Grip 10, as shown in FIG. 1, includes a two-sided sheet having a radius of curvature that facilitates the engagement of an oil filter 20, as shown in FIG. 2.

Grip 10 includes an outside surface 14 and an inside surface 18, as shown in FIG. 1. Outside surface 14 is adapted to provide for non-slip engagement between a user's hand and outside surface 14. Additionally, outside surface 14 can provide for non-slip engagement between a tool such as a wrench (not shown) and outside surface 14. In the illustrative embodiment, outside surface 14 includes a grit coating for providing the non-slip engagement surface.

Inside surface 18 is configured to provide for non-slip engagement between grip 10 and an oil filter 20, as shown in FIG. 2. Illustratively, inside surface 18 can also include a grit coating for providing the non-slip engagement surface adapted for handling oil filter 20. The grit coating on both outside surface 14 and inside surface 18 further provides thermal protection to a user of grip 10 in the event oil filter 20 is hot from engine use.

In the illustrative embodiment, grip 10 comprises two sheets of sandpaper affixed back-to-back such that outside sheet 12 has an outside grit surface 14 that provides a non-slip, thermally protected surface for gripping by a user, and such that an inside sheet 16 also has an inside grit surface 18 useful for engaging an oil filter that may be covered with oil and grime. Outside sheet 12 and inside sheet 16 are affixed to each other in a manner that provides a natural curve to grip 10, as is shown in FIG. 1. However, it is within the scope of the disclosure to affix outside sheet 12 and inside sheet 16 such that no curve exists in grip 10. Grip 10 can be left to include no curve, or can be formed into a curve in a later process, such as in a heating process which is used to form grip 10 to the desired shape under the influence of heat.

Figure 3:
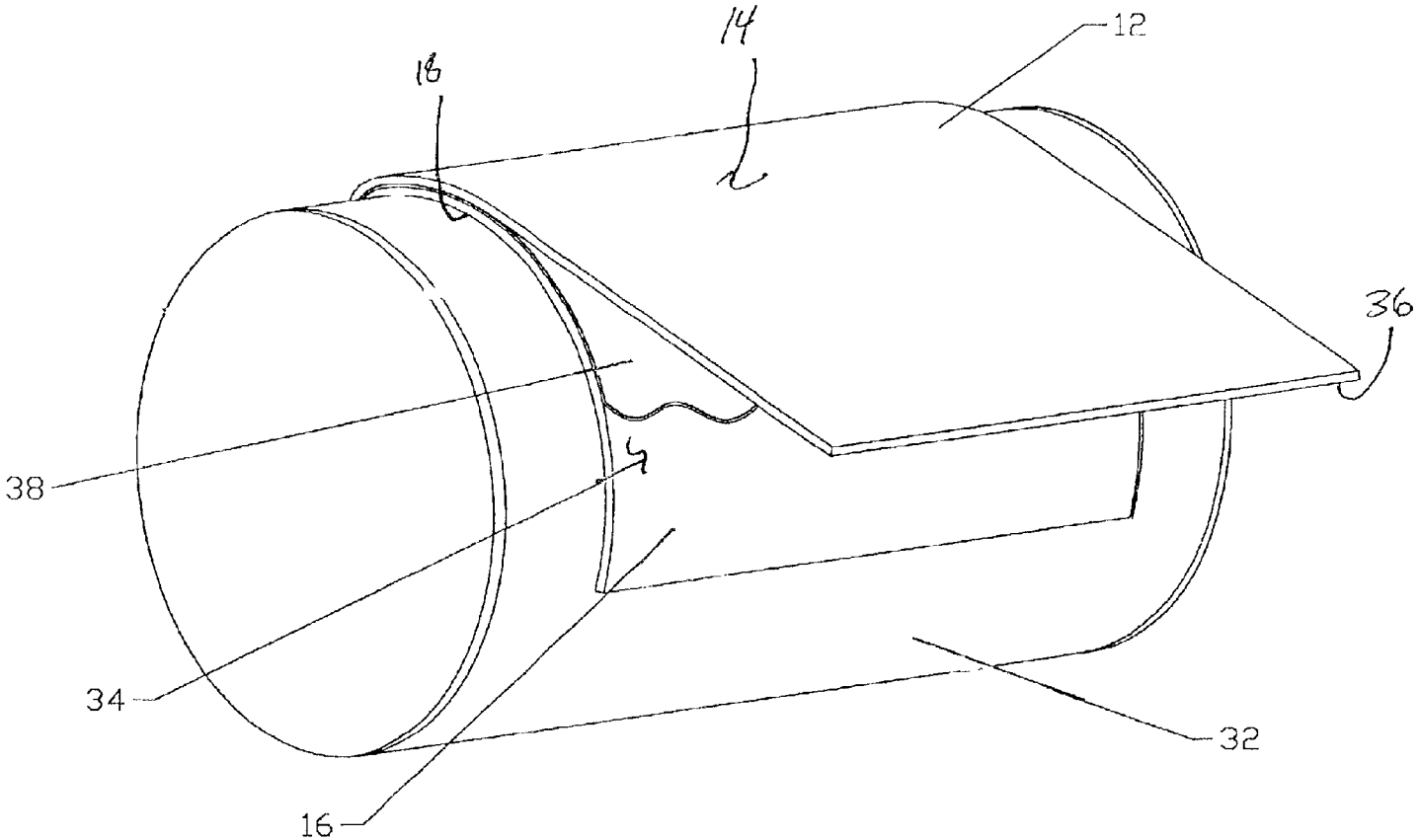
FIG. 3 is a perspective view of a tool used in forming the filter grip.

Grip 10 is illustratively formed into a desired curve in the following manner. A roller 32 is provided having the desired state of curvature, as shown in FIG. 3. It should be understood, however, that other formations and curvatures for roller 32 are within the scope of the invention. For example, a frame (not shown) having varied radii of curvature could be used in place of roller 32, wherein grip 10 is formed about the frame such that grip 10 is resultingly configured in a shape substantially similar to the frame.

When forming grip 10 about the roller 32 or a frame, inside sheet 16 is mounted to roller 32 such that inside surface 18 faces inwardly and inside sheet 16 takes the form of the desired curvature. An adhesive 38 is then applied to either an outside surface 34 of inside sheet 16 or to an inside surface 36 of outside sheet 12. Alternatively, adhesive 38 can comprise a middle layer positioned between inside sheet 16 and outside sheet 12.

After adhesive 38 is applied, outside sheet 12 is positioned to form about inside sheet 16 such that outside sheet 12 also takes the form of the desired curvature. Because inside sheet 16 and outside sheet 12 are adhered while in the desired radius of curvature, grip 10 substantially holds the desired curvature so that an oil filter 20 can more easily be handled by a user.

Although the invention has been described in detail with reference to certain preferred embodiments, variations and modifications exist within the scope and spirit of the invention as described and defined in the following claims.

What is claimed is:

1. A grip for engaging an oil filter, the grip comprising a first sheet of sandpaper having a back surface and a grit front surface, and a second sheet of sandpaper having a back surface and a grit front surface, wherein the second sheet back surface is affixed to the first sheet back surface and the first and second sheets cooperate to define a combined sheet having a length axis, a shorter width axis, and a radius of curvature about an axis that is parallel with the width axis.

2. The grip of claim 1, wherein the radius of curvature is approximately3 inches.

3. The grip of claim 1, wherein the first sheet grit front surface is configured to engage the oil filter.

4. The grip of claim 1, wherein the second sheet grit front surface is configured to be engaged by a user's hand.

5. The grip of claim 1, wherein the second sheet grit front surface is configured to be engaged by a tool.

6. The grip of claim 1, wherein the combined sheet provides a thermal barrier between a user and the oil filter.

7. A method of forming a grip for an oil filter, comprising the steps of providing a first sheet having a back surface and a grit front surface, providing a second sheet having a back surface and a grit front surface, placing the first sheet on a frame defining a radius of curvature such that the grit front surface faces toward the frame, applying an adhesive to the back surface of one of the first and second sheets, and positioning the second sheet adjacent the first sheet such that the back surface of the second sheet adheres to the back surface of the first sheet and the two sheets form a combined sheet having a length axis, a shorter width axis, and a radius of curvature about an axis that is parallel with the width axis.

8. The method of claim 7, further comprising the step of providing an oil filter.

9. The method of claim 8, further comprising the step of wrapping the grip around the oil filter.

10. A grip for engaging an oil filter, the grip comprising a sheet having a back surface and a front surface, wherein the back and front surfaces have a grit texture and the sheet defines a dimension and a radius of curvature that has an axis that is parallel with the dimension.

11. The grip of claim 10, wherein the sheet comprises sandpaper.

12. The grip of claim 10 wherein the sheet comprises a first layer of sandpaper and a second layer of sandpaper.

13. The grip of claim 12 wherein the first layer of sandpaper is adhered to the second layer of sandpaper.

* * * * *